US007143821B2

(12) United States Patent
Meissner et al.

(10) Patent No.: US 7,143,821 B2
(45) Date of Patent: Dec. 5, 2006

(54) APPARATUS FOR COOLING METAL TUBES

(76) Inventors: Alan L. Meissner, 1123 S. 4th, Dayton, WA (US) 99328; Penny D. Meissner, 1123 S. 4th, Dayton, WA (US) 99328; Marty H. Meissner, 84349 Highway 339, Milton-Freewater, OR (US) 97862; James E. Lilwall, 521 Hatch, Walla Walla, WA (US) 99362

( * ) Notice: Subject to any disclaimer, the term of this patent is extended or adjusted under 35 U.S.C. 154(b) by 563 days.

(21) Appl. No.: 10/226,612

(22) Filed: Aug. 22, 2002

(65) Prior Publication Data

US 2004/0094025 A1 May 20, 2004

(51) Int. Cl.
*F28F 13/12* (2006.01)
*F41A 13/00* (2006.01)

(52) U.S. Cl. ..... 165/122; 165/77; 165/157

(58) Field of Classification Search ..... 165/121, 165/122, 123, 67, 75, 76, 77, 157; 89/14.1; 42/90

See application file for complete search history.

(56) References Cited

U.S. PATENT DOCUMENTS

| | | | | | |
|---|---|---|---|---|---|
| 1,884,094 | A * | 10/1932 | Modine | 165/53 |
| 3,115,757 | A * | 12/1963 | Day | 62/507 |
| 4,159,588 | A * | 7/1979 | Pfeiffer | 42/90 |
| 4,423,703 | A * | 1/1984 | Esselman et al. | 122/510 |
| 4,874,040 | A * | 10/1989 | Herrmann | 165/122 |
| 5,117,734 | A | 6/1992 | Rhoads | 89/14.1 |
| 6,105,376 | A * | 8/2000 | Stewart et al. | 62/171 |
| 6,272,876 | B1 * | 8/2001 | Roberts et al. | 62/255 |
| 6,705,195 | B1 * | 3/2004 | Thornton | 89/14.1 |

* cited by examiner

*Primary Examiner*—Tho v. Duong
(74) *Attorney, Agent, or Firm*—Floyd E. Ivey; Liebler, Ivey, Connor, Berry & St. Hilaire

(57) ABSTRACT

A cooler for one or a plurality of metal tubes with a cooler housing having intake vents, a powered turbine, at least one exhaust holes and metal tube supports. The one or a plurality of metal tubes received by metal tube supports and positioned to receive coolant flow from the turbine.

6 Claims, 4 Drawing Sheets

APPARATUS FOR COOLING METAL TUBES

FIELD OF THE INVENTION

The present invention relates generally to an apparatus for cooling metal tubes and, more particularly, to an apparatus for the cooling of rifle barrels.

BACKGROUND OF THE INVENTION

Target shooting and other rifle and pistol use involving shooting multiple shots within a short time causes barrel overheating. Continued firing, following overheating, can cause erosion and other damage to the barrel. The user must delay further shooting until the barrel cools. The issue is addressed in U.S. Pat. No. 5,117,734 where a ventilating fan attached to the end of a rifle barrel blows air into the bore or pulls the air away from the bore. The Apparatus of Patent '734 is inefficient in cooling requiring excessive time to effect cooling. The foregoing patents and printed publications are provided herewith in an Information Disclosure Statement in accordance with 37 CFR 1.97.

SUMMARY OF THE INVENTION

The prior art requires excessive time in cooling a barrel. The principal mass of a heated rifle barrel is centered around the chamber. Two main factors contribute to the heating of a rifle barrel. First, a shell explodes in the chamber introducing a large amount of energy. Second, the mass of metal in the chamber area is nominally the greatest mass of metal in the rifle which additionally is generally insulated by the rifle stock. These factors combine to make the chamber the hottest portion of the rifle. The apparatus and method of Patent '734 either directs the coolest air to the rifle bore or pulls cool air from the open chamber to the rifle bore. Either approach limits the volume of air by the restriction of the rifle bore. This method and apparatus of the present invention overcomes this limitation thus reducing the time required to cool the rifle.

The present invention minimizes and in some aspects eliminates several of the disadvantages of the prior related art. The present invention uses a cooling fluid to remove the heat out of the chamber area of the metal tube first and thereby cools the metal tube in less time than the prior related art.

The present invention is directed to a cooler for metal tubes that have become heated. In one embodiment a rifle is received into a cooler (1) where the rifle, or metal tube, is supported by metal tube supports (80). In the preferred embodiment the cooler (1) comprises a cooler housing (10) sized to receive a rifle. The cooler housing (10) is essentially an enclosed box having intake and exhaust means and a turbine or fan means for the introduction of air directed to the hottest and most massive portion of the metal tube or rifle. An alternative embodiment will accommodate one or a plurality of metal tubes, rifles or pistols. An additional embodiment will be portable for use in the field, possibly in a police or military setting, where the cooler housing (10) is received directly around a rifle chamber for the direction of cooling fluids into the rifle chamber with exhaust out the rifle bore.

BRIEF DESCRIPTION OF THE DRAWINGS

The foregoing aspects and other features of the present invention are explained in the following description, taken in connection with the accompanying drawings, wherein.

DETAILED DESCRIPTION OF THE INVENTION

Figure 1:
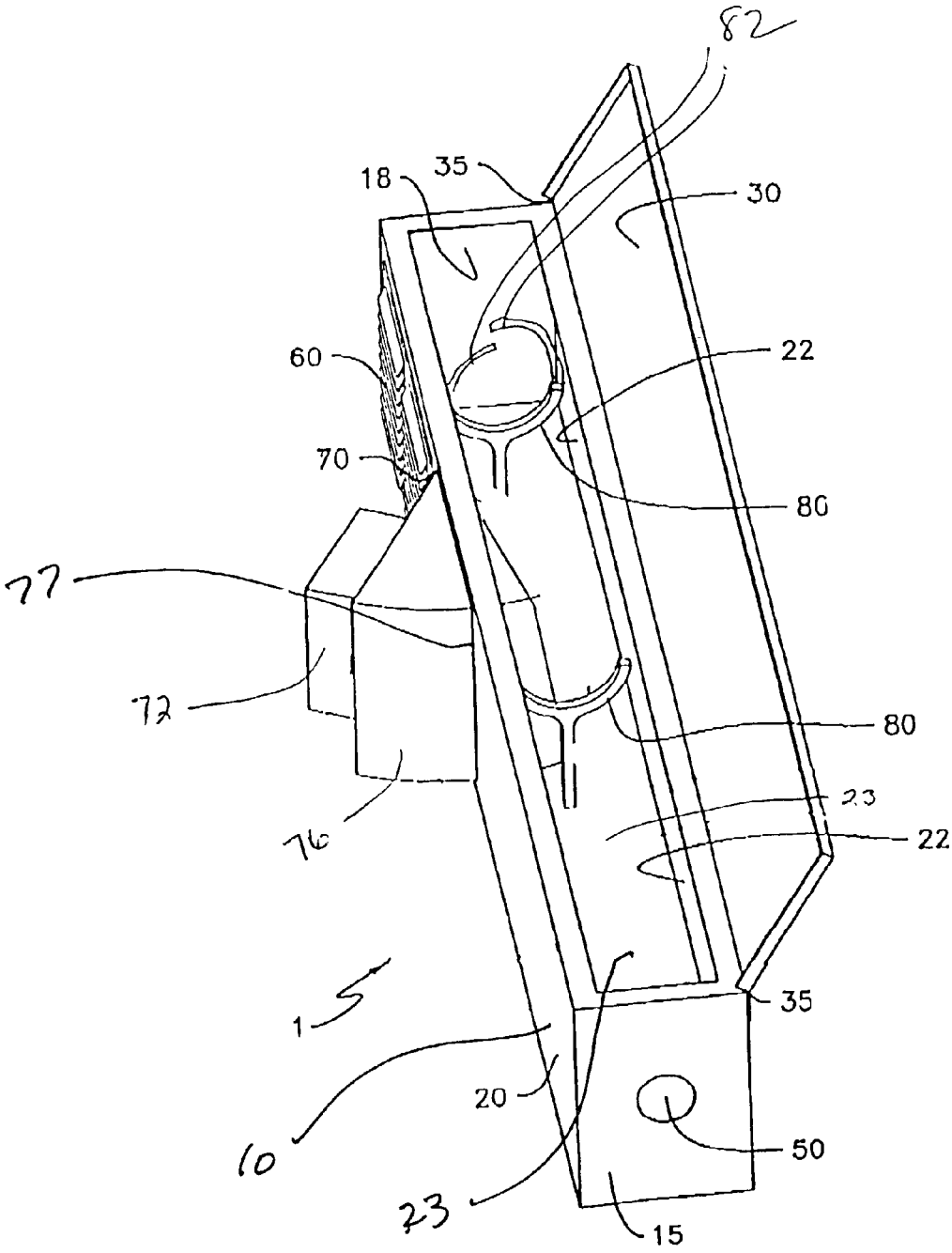
FIG. 1 shows the cooler (1) showing the cooler housing (30) having a turbine side (20), back side (22), intake end (18), exhaust end (15) showing an exhaust hole (50), bottom (23) and top (30). The top (30) is depicted as rotatably interconnected with the back side (22) via a hinge means shown here as a top hinge (35). Also seen are intake vents (60), metal tube supports (80), turbine (72) with turbine housing (76) and turbine housing hinge pin (70). The turbine housing (76) is shown in a partially open position.

For the purposes of promoting an understanding of the principles in accordance with the invention, reference will now be made to the embodiments illustrated in the drawings and specific language will be used to describe the same. It will nevertheless be understood that no limitation to the scope of the invention is thereby intended. Any alternatives or further modifications of the invention features illustrated herein, and any additional application of the principles of the invention as illustrated herein, which would normally occur to one skilled in the relative art and having possession of this disclosure, are to be considered within the scope of the invention claimed.

Figure 2:
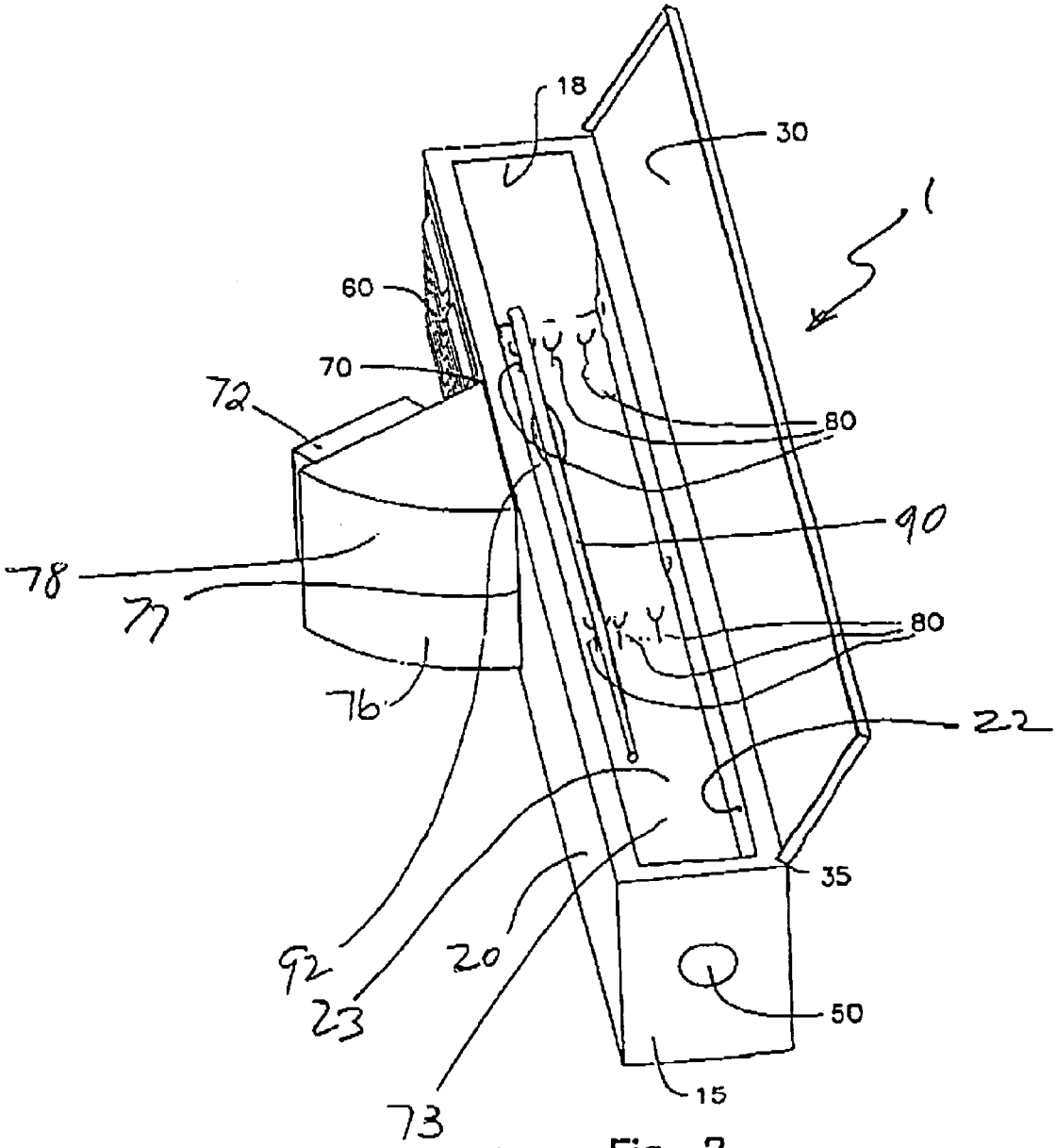
FIG. 2 is an overhead view of a cooler (1) the top (30) opened and the turbine housing (76) in the fully opened position.
Figure 3:
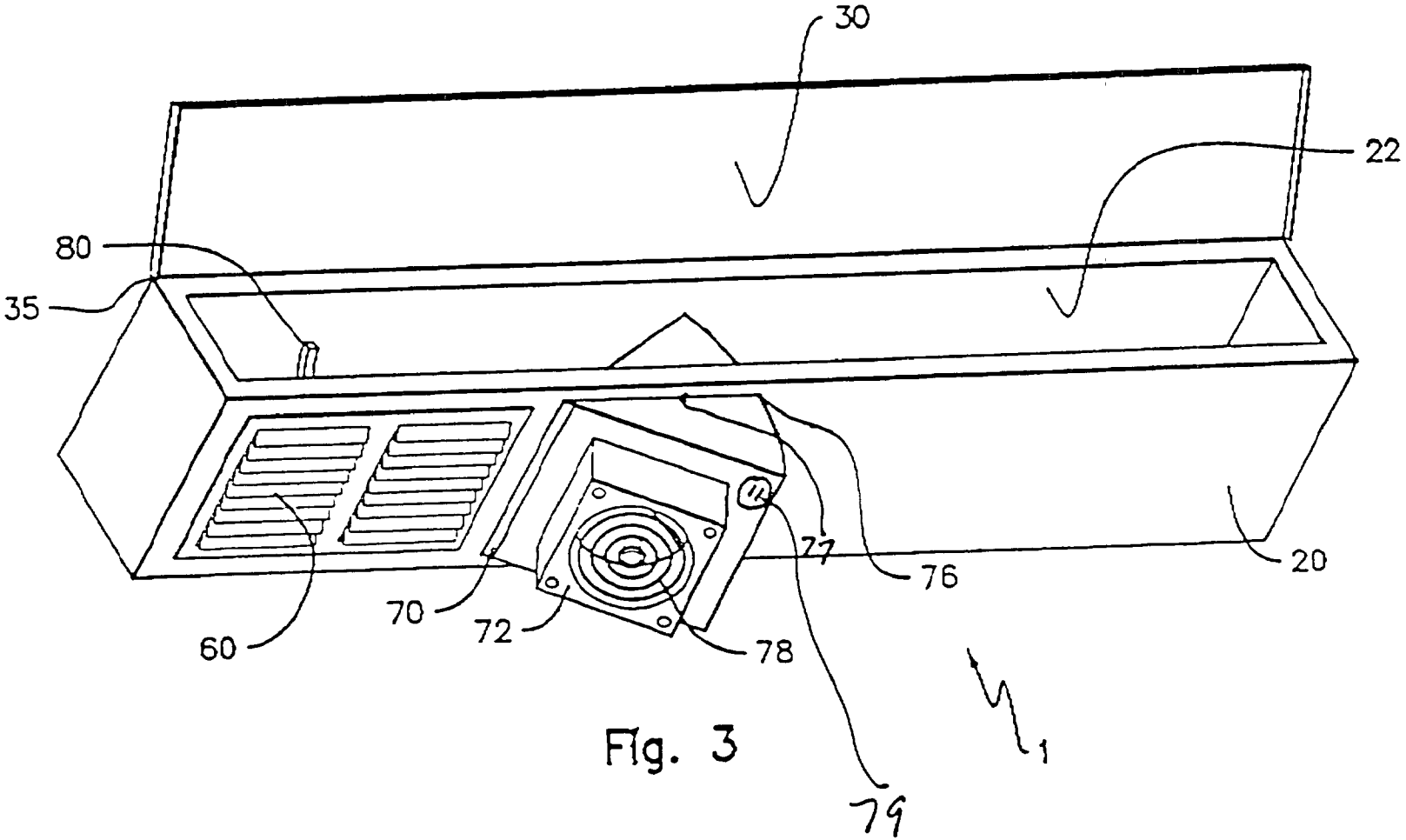
FIG. 3 is a front elevation perspective of the cooler (1) with the top (30) opened and the turbine housing (76) partially opened. Also shown is turbine power means (79) depicted as an electrical male connector to receive standard 110 vac.

FIGS. 1, 2 and 3 show the preferred embodiment of the cooler (1) showing the cooler housing (30) having a turbine side (20), back side (22), intake end (18), exhaust end (15) showing an exhaust hole (50), bottom (23) and top (30). The top (30) is depicted as rotatably interconnected with the back side (22) via a hinge means shown here as a top hinge (35). Also seen are intake vents (60), metal tube supports (80), turbine (72) with turbine housing (76) and turbine housing hinge pin (70). The turbine housing (76) is shown in a partially open position. Also shown is turbine power means (79) depicted as an electrical male connector to receive standard 110 vac. Those of ordinary skill in the electrical arts will recognize that power for the turbine (72) may be provided by a variety of electrical means including batteries and interconnection means of wiring and switches. As shown in FIGS. 1, 2 and 3, the top (30) is shown in an open position. The top (30) will be closed for cooling operations. It will be recognized by those of ordinary skill that the invention disclosed may accommodate one or a plurality of metal tubes or rifles for cooling purposes as is depicted in FIG. 2 wherein 1–n metal tube supports (80) are depicted. It will be appreciated that the cooler housing (10) will be formed to accommodate the shape of the metal tubes to be cooled. It will be recognized that metal tube supports (80) are affixed by affixing means at the inside of the cooler housing (30) where affixing means may be by screw, threaded bolt with nut, welding and other recognized affixing means. Thus the depiction of FIGS. 1, 2 and 3 will be recognized as a convenient "box" form for illustrative purposes and that the application may dictate other shapes and forms.

In the preferred embodiment the exhaust end (15) and the intake end (18) may both include openings to provide intake and exhaust purposes. Depicted here are intake vents (60) at the turbine side (20) proximal the intake end (18). Those of ordinary skill will recognize that intake means of vents or other apertures may be formed at the intake end (18) or at the top (30), turbine side (20), bottom (23) or back side (22) intermediate the intake end (18) and the turbine (72). In the preferred embodiment the exhaust end (15) will have an aperture means shown in this disclosure as an exhaust hole (50) which may, as would be recognized by those of ordinary skill as vents, slots, or other openings permitting cooling fluid flow. Those of ordinary skill will recognize that exhaust means of holes (50), vents or other apertures may be formed at the exhaust end (15) or at the top (30), turbine side (20), bottom (23) or back side (22) intermediate the exhaust end (15) and the turbine (72) or at the exhaust end (15).

The cooler (1) is shown to present a turbine housing aperture (77) which receives the turbine housing (76). Those of ordinary skill will recognize that the turbine housing aperture (77) and turbine housing (76) may be placed at the top (30), back side (22), turbine side (20) or bottom (23). In the preferred embodiment the turbine housing (76) is pivotably affixed by pivot affixing means at the turbine side (20) intermediate the intake end (18) and the exhaust end (15). In the preferred embodiment the turbine housing (76). Pivot affixing means shown in the preferred embodiment as a turbine housing hinge (70). The turbine housing (76) is pivoted to place the turbine housing (76) at the inside (73) of the cooler housing (10) for ease of transport of the cooler (1). In the preferred embodiment, for operation of the cooler (1), the turbine housing (76) is pivoted to an open position where the turbine housing (76) is outside the cooler housing (10). In the open position (78), for operation, the turbine housing (76) directs, in the preferred embodiment, a coolant toward the one or a plurality of metal tubes (90) or, as indicated for the preferred embodiment, rifles. In the preferred embodiment the coolant will be directed to the more massive and hot portion of the one or a plurality of metal tubes (90), i.e., for a rifle with a hot barrel, toward the rifle chamber. The rifle chamber will be in an open position. In the preferred embodiment the turbine housing (76) and turbine (72) will direct the coolant toward the exhaust end (15) creating a draft from the inlet end (18) thus introducing additional coolant, i.e., ambient air in the preferred embodiment, in addition to coolant introduced by the turbine (72). Those of ordinary skills will recognize that the turbine (72) may direct coolants other than ambient air. In the preferred embodiment the turbine (72) will direct the coolant into the open rifle chamber with exhaust partially through the metal tube (90) end proximal the exhaust end (15). The coolants can be selected from a broad range of substances including: ambient air, and other fluids including other gases and liquidized gas or liquid. The turbine (72) is typically an electrical fan but may include any type of turbine that can project or pump a coolant, including liquid or gas, on or into the metal tube intermediate the intake end (18) and the exhaust end (15). FIG. 3 depicts an electrical connection means, shown as a male electrical connector for 120 vac, for delivery of power to the turbine. Those of ordinary skill will recognize that other power means may be used requiring electrical connectors of other configurations including, for example, for delivery of power from an automotive 12vdc system and other power sources. The turbine may be powered by other then electricity wherein the connection device may, for example, be a hydraulic or pneumatic connector. Switch means, for power on/off, will be provided as required as will be appreciated by those of ordinary skill. In alternative embodiments, the turbine (72) may be directed to either force coolant in the general direction of the inlet end (18). Alternatively, inlet and exhaust means may be positioned in the top (30), back side (22), or bottom (23) or turbine side (20) with the turbine (72) directing the coolant flow as most effectively used.

In the preferred embodiment the top (30) is depicted as pivotally attached to the back side (22) with a hinge means shown as the top hinge (35), comprised, in the preferred embodiment of a piano hinge means. It is recognized that the opening for insertion of the one or a plurality of metal tubes (90) may be from the turbine side (20), the bottom (23), the back side (22), the top (30), the intake end (18) or the exhaust end (15) with the depiction shown in FIGS. 1, 2 and 3 merely showing a representative means for gaining access to the cooler (1) for placement of the one or a plurality of metal tubes (90) or, as will be placed in the preferred embodiment, rifles. It is also recognized that the metal tube supports (80) may have enclosure means (82) which encompass or secure the metal tube (90) in the respective metal tube supports (80), e.g., such enclosure means (82) may be velcro strips placed to encircle the respective metal tube (90) allowing the cooler (1) to be operated in a variety of configurations including horizontal and vertical. Other enclosure means (82) will be recognized by those of ordinary skill in the fixing/securing arts which will be equivalent in providing securing and enclosure means (82).

In the preferred embodiment the bottom side 23 will receive at least one metal tube support (80) and generally one or a plurality of metal tube supports (80) which will hold the metal tubes (90) in the optimum position to receive the turbine (72) directed coolant. The metal tube supports (80) may be made of any material physically capable of supporting the metal tubes (90). For example the metal tube supports (80) may be made of metal in the form of a stirrup or rubber in the form of a grommet. In order to reach the optimum position for the turbine (72) directed coolant, the metal tube supports (80) may be rotated to position the metal tubes (90) toward the flow of coolant directed from the turbine (72).

It will be seen from FIGS. 1, 2 and 3 that the turbine (72) may be oriented to force the coolant away from the metal tube (90) thereby causing coolant to be received through the inlet and exhaust ends (18, 15) or the intake vents (60) and exhaust hole (50). Those of ordinary skill will recognize that the turbine (72) may be positioned in the turbine housing (76) so as to be contained within the turbine housing (76) or to protrude from the turbine housing (76). In the preferred embodiment, the turbine housing (76), when pivoted to place the turbine housing (76) at the inside (73) of the cooler housing (10) for transport and outside the cooler housing (10) for operation.

Of particular interest to the applicant herein, are rifles and the cooling of rifle barrels. However, this apparatus may also be employed to cool other heated metal tubes including cannons, and other firearms.

Figure 4:
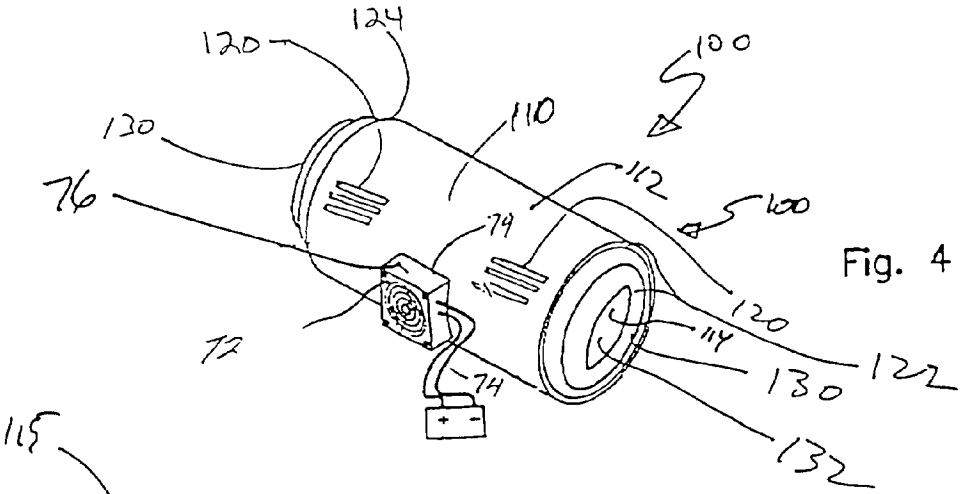
FIG. 4 is a view of a portable cooler (100) with portable cooler housing (110) showing a turbine (72) with turbine housing (76), first and second ends (122, 124) and portable turbine power means (74). Portable turbine power means (74) shown here as an interconnection with a battery power supply. Also seen are at least one cooler housing boot (130) having an elastic cooler housing boot aperture (132).
Figure 5:
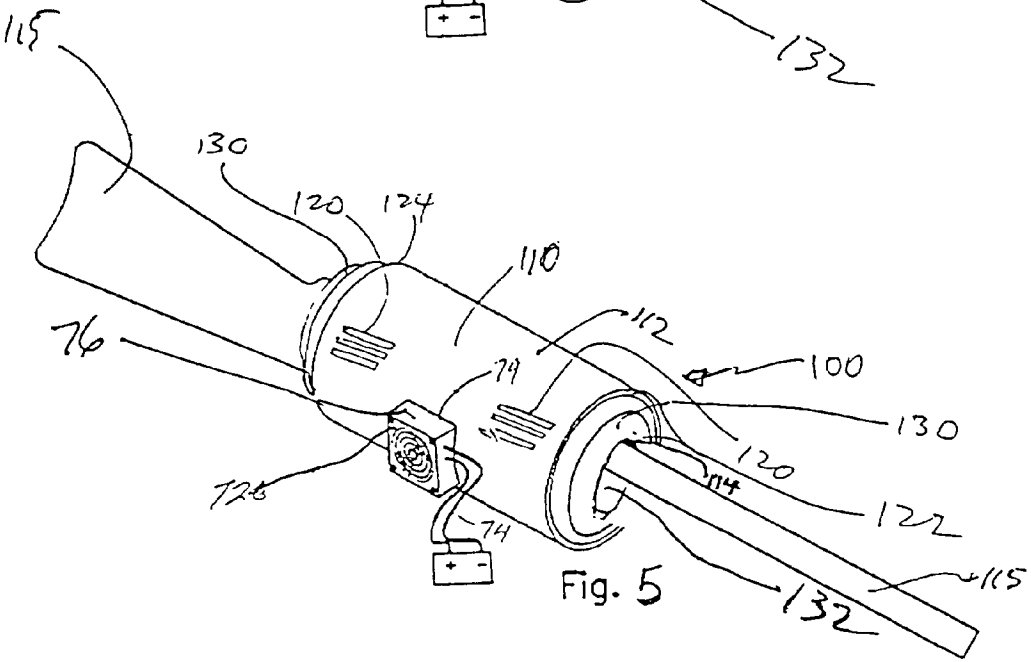
FIG. 5 is a view of a portable cooler (100) where the metal tube to be cooled is of such a length to require a second cooler housing boot (130) having an elastic cooler housing boot aperture (132) at the second end (124). Depicted is a rifle received into the invention.

An alternative embodiment, depicted in FIGS. 4 and 5, is a portable cooler (100) comprising a portable cooler housing (110) for a single metal tube. This embodiment is comprised of a portable cooler housing (110) having at least one turbine (72) with a turbine housing (76) where the turbine housing (76) is received by the portable cooler housing (110) at a turbine aperture (79) from the outside to the inside (112, 114), an outside (112) and an inside (114), a first and second end (122, 124), power means (74) indicated as a battery and appropriate electrical interconnection means including cabling for the delivery of power to propel the turbine (72), cooler housing vents (120) to allow intake and exhaust of coolants and at least one cooler housing boot (130), at the second end (124), having an elastic cooler housing boot aperture (132) which elastically receives a metal tube. The at least one cooler housing boot (130) at the elastic cooler housing boot aperture (132) will elastically fit securely about the metal tube thereby allowing effective direction of coolant by the turbine (72). In the instance where the metal tube is of such length as to require passing through the portable turbine housing (110) in order to place the massive portion of the metal tube in the direct flow of coolant, e.g., where the metal tube is a rifle with a hot barrel, there will be at least two cooler housing boots (130), at least one at the second end (124) and at least one at the first end (122), having elastic cooler housing boot apertures (132) permitting the rifle barrel to be received through both elastic cooler housing boot apertures (132) to position the turbine (72) to direct coolant into an open chamber with the respective elastic cooler housing boot apertures (132) fitting securely about the portion of the rifle as required for the positioning of the turbine (72) proximal an open chamber of a rifle.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

We claim:

1. An Apparatus for Cooling Metal Tubes comprising:

a. a cooler housing (10) sized to receive one or a plurality of metal tubes (90); the one or a plurality of metal tubes (90) having a massive portion (92); the cooler housing (10) having an inside (73);

b. a turbine (72) received by the cooler housing (10) and positioned to direct a coolant at the metal tube massive portion (92); power means provided to power the turbine (72);

c. the cooler housing (10) having inlet and exhaust means to allow flow of coolant for cooling of the metal tube;

d. the cooler housing (10) having a turbine side (20); the turbine side (20) having a turbine aperture (77); the turbine (72) received into a turbine housing (76); the turbine housing received by the turbine housing aperture (77);

e. the turbine housing (76) is pivotally affixed by pivot affixing means at the turbine side (20) and turbine housing aperture (77) to pivot in the turbine housing aperture (77) from the inside (73) to a position outside the cooler housing (10);

f. the cooler housing (10) being elongated and having an intake end (18) and an exhaust end (15); the turbine (72) mounted intermediate the intake end (18) and the exhaust end (15);

g. metal tube supports (80) mounted with mounting means at the inside (73) of the cooler housing (10) to receive the metal tube (90) so that the turbine (72) directs a coolant at the massive portion (92);

h. the turbine housing aperture (77) is intermediate the intake end (18) and the exhaust end (15);

i. the cooler housing (10) having a back side (22), bottom (23) and top (30); inlet and exhaust means may be positioned in the top (30), backside (22), or bottom (23) or turbine side (20);

j. inlet and exhaust means comprised of intake vents (60) at or proximal to the intake end (18); at least one exhaust hole (50) at or proximal to the exhaust end (14);

k. pivot affixing means comprising a turbine housing hinge (70); the turbine housing (76) pivots to place the turbine housing (76) at the inside (73) of the cooler housing (10) for ease of transport of the cooler (1) and at the outside of the cooler housing (10) for cooler (1) operation.

2. The invention of claim 1 further comprising:

a. the turbine housing (76), when pivoted outside the cooler housing (10) positioned to direct a coolant toward the one or a plurality of metal tubes (90) at the massive portion (92); the turbine housing (76) and turbine (72) positioned to direct the coolant toward the exhaust end (15) creating a draft from the inlet end (18) thus introducing additional coolant to the inside (73) of the cooler housing (10).

3. The invention of claim 2 further comprising:

a. the coolant comprised of ambient air, other gases, liquidized gases or liquids;

b. the turbine (72) comprised of an electrical fan or a turbine that can project or pump a coolant; switch means is provided for control of the turbine (72).

4. The invention of claim 3 further comprising:

a. the top (30) is rotatably interconnected with the back side (22) via a hinge means;

b. the intake vents (60) formed at the intake end (18) or at the top (30), turbine side (20), bottom (23) or back side (22) intermediate the intake end (18) and the turbine (72); the at least one exhaust hole (50) formed at the exhaust end (15) or at the top (30), turbine side (20), bottom (23) or back side (22) intermediate the exhaust end (15) and the turbine (72);

c. the turbine housing aperture (77) and turbine housing (76) formed, at the turbine side (20) intermediate the intake end (18) and the exhaust end (15);

d. the one or a plurality of metal tubes (90) comprised of one or a plurality of rifles; the rifles having rifle barrels; the rifles having rifle chambers comprising the massive portion (92); the rifle chambers are in an open position during cooling operations; the turbine (72) positioned to direct the coolant into the open rifle chambers with exhaust partially through the rifle barrels and the at least one exhaust hole (50).

e. the metal tube supports (80) each have enclosure means (82) to secures each of the one or a plurality of rifles (90) in the respective metal tube supports (80).

5. The invention of claim 4 further comprising:

a. the metal tube supports (80) affixed by affixing means at the inside (73) of the cooler housing (10) at the bottom (23); the metal tube supports (80) enclosure means (82) comprised of velcro strips placed to encircle the respective one or a plurality of rifles (90).

6. The invention of claim 5 further comprising:

a. the metal tube supports (80) may be made of metal in the form of a stirrup or rubber in the form of a grommet; the metal tube supports (80) capable of rotation, by rotation means, to position the metal tubes (90) toward the flow of coolant directed from the turbine (72).

* * * * *